United States Patent [19]

Rivera

[11] Patent Number: 5,005,673

[45] Date of Patent: Apr. 9, 1991

[54] COORDINATED ELEVATOR CAR DOOR-HALL DOOR MOVEMENT

[75] Inventor: James A. Rivera, Bristol, Conn.

[73] Assignee: Otis Elevator Company, Farmington, Conn.

[21] Appl. No.: 413,028

[22] Filed: Sep. 27, 1989

[51] Int. Cl.[5] ..... B66B 13/00

[52] U.S. Cl. ..... 187/52 LC; 49/116

[58] Field of Search ..... 187/52 LC, 56, 51, 61; 49/116, 118, 62, 120

[56] References Cited

U.S. PATENT DOCUMENTS 3,065,826 11/1962 Tucker, Jr. ..... 187/52 LC
3,605,952 9/1971 Lusti ..... 187/52 LC
3,783,977 1/1974 Voser ..... 187/52 LC

FOREIGN PATENT DOCUMENTS 1002929 2/1957 Fed. Rep. of Germany ... 187/52 LC

*Primary Examiner*—Robert P. Olszewski
*Assistant Examiner*—Kenneth Noland
*Attorney, Agent, or Firm*—William W. Jones

[57] ABSTRACT

Movable vanes mounted on the exterior of an elevator car door engage rollers on the interior of the hallway door as the car door commences to open. Subsequent opening and closing movement of the car and the hallway doors occurs simultaneously and at the same speed so that there is no mismatched motion between the doors.

7 Claims, 4 Drawing Sheets

COORDINATED ELEVATOR CAR DOOR-HALL DOOR MOVEMENT

DESCRIPTION

1. Technical Field

This invention relates to elevator door operation and, more particularly, to an assembly for interconnecting an elevator car door and a hallway door during the opening and closing thereof.

2. Background Art

Many systems have been devised for coordinating the opening and closing movement of the car door and the hallway door in an elevator assembly. Typically, the hallway door will be latched closed at all times from inside the hoistway. The elevator car will carry an electric motor which operates the car door or doors when the car stops at a landing. The motor will hold the car door closed until activated to a door-opening stroke. There will be a make and break connection between the car door and the hallway door whereby movement of the car door will result in unlatching of the hallway door and then opening of the hallway door, with the motive power being supplied by the electric door operating motor on the car. Thus there will be a connection between the car and hallway doors when the doors are opening or closing, and there will be no such connection when the car is moving through the hoistway. It is highly desirable for passenger comfort to ensure that the car doors and the hallway doors move in perfect synchronism as they open and close to the extent that a passenger is aware of the opening and closing movement of the doors. At the same time it is desirable and necessary to provide a durable and relatively simple assembly for connecting the doors.

The prior art discloses many specific connections which use vanes, rollers, pivoting link arms and the like to interconnect the car and hallway doors. One problem that occurs in some of the prior art assemblies relates to the need to produce concurrent door movement throughout the entire opening and closing strokes. The prior art systems will begin the movement of both doors evenly, and end it evenly, but during the opening and closing strokes, one door will move at a different speed from the other. This occurs as the result of using pivoting links to connect the doors. This differential rate of movement can cause malfunctioning of door detectors which will cause the doors to cycle between opening and closing strokes.

DISCLOSURE OF THE INVENTION

The elevator door interconnecting assembly of this invention provides a constant coordination of car and hallway door velocity from the time both doors begin to move until the time the hallway door stops moving. The door connection is made by a pair of vanes mounted on the car door and a pair of rollers mounted on the hallway door. The car door vanes are capable of moving toward and away from each other, are biased for movement away from each other, but are held in a collapsed position when the car door is closed. The rollers mounted on the hallway door are spaced far enough apart so that the car door vanes can pass between the rollers as the car moves up and down in the hoistway with its door closed. When the car stops in front of a hallway door, the car door vanes will be positioned between the hallway door rollers. As the car door begins to open, the car door vanes spread apart and engage both of the hallway door rollers. This causes the hallway door to unlatch. Further movement of the car door causes the hallway door to open. Engagement between the vanes and rollers continues throughout the entire opening and closing strokes. Only during the initial and final fractions of car door movement does the latter move independently of the hallway door.

It is therefore an object of this invention to provide an assembly for interconnecting elevator car and hallway doors during the opening and closing movement thereof.

It is an additional object of this invention to provide an assembly of the character described which allows free passage of the car through the hoistway.

It is a further object of this invention to provide an assembly of the character described wherein the car and hallway doors move in synchronism as they open and close.

It is another object of this invention to provide an assembly of the character described which is rugged, uncomplicated and reliable in operation.

These and other objects and advantages of the invention will become more readily apparent to those skilled in the art from the following detailed description of a preferred embodiment thereof when taken in conjunction with the accompanying drawings, in which:

BEST MODE FOR CARRYING OUT THE INVENTION

Figure 1:
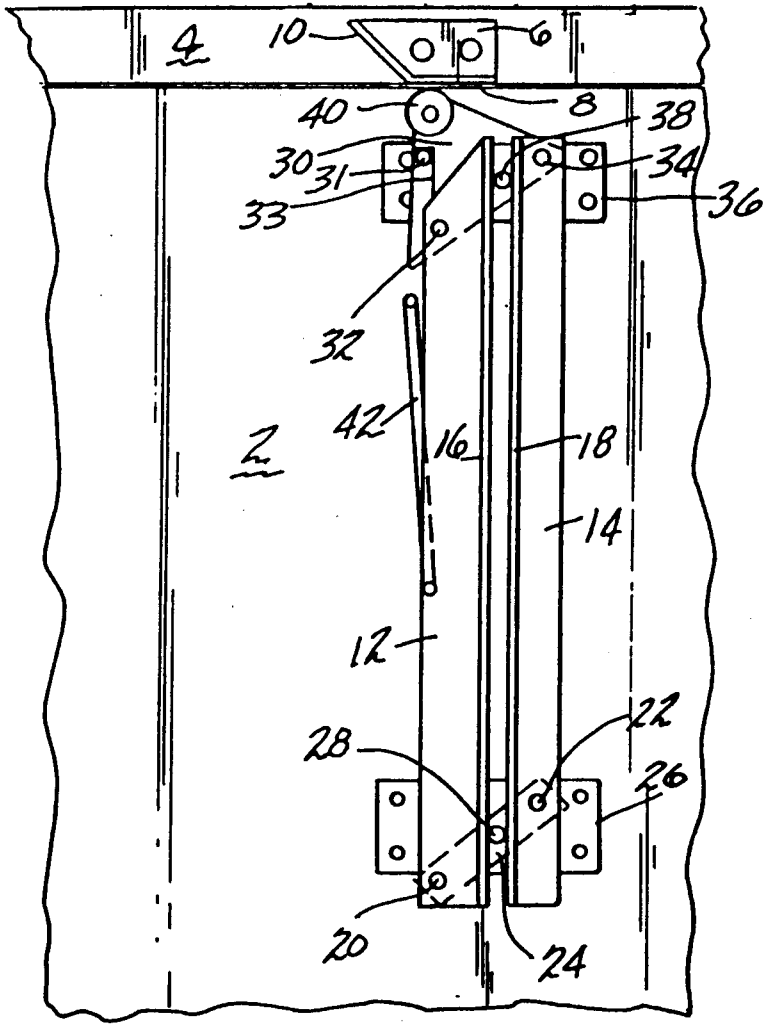
FIG. 1 is a fragmented elevational view of the vane subassembly portion of the invention which is mounted on the elevator car door, the subassembly being shown in its collapsed condition when the door is fully closed.
Figure 2:
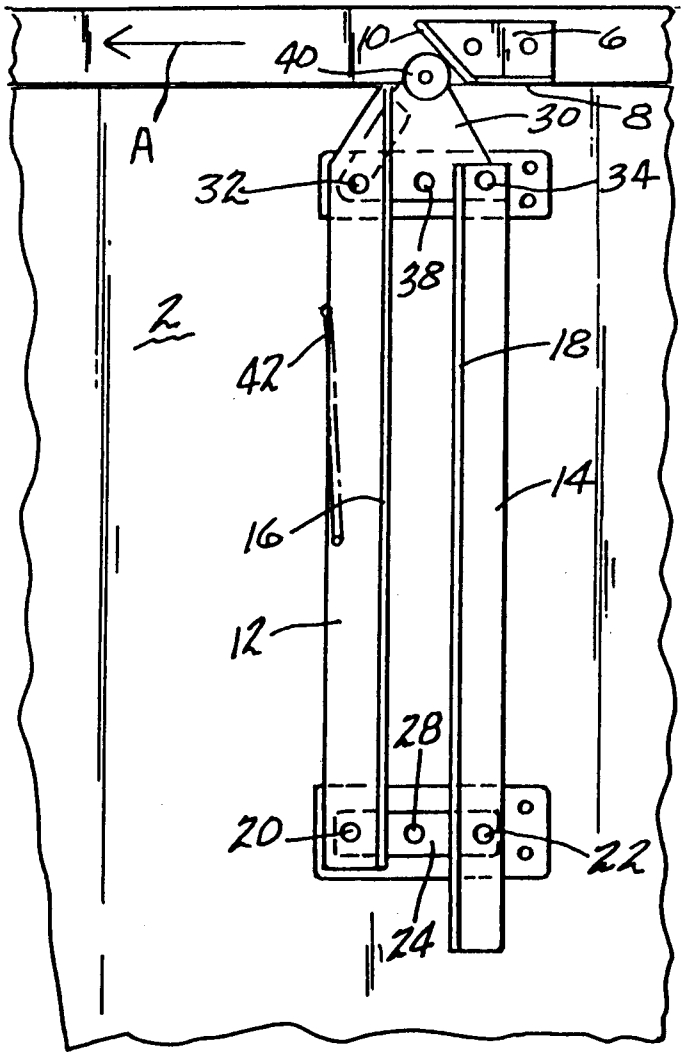
FIG. 2 is a view similar to FIG. 1 but showing the subassembly in its expanded condition when the door is being opened or closed.

Referring now to FIGS. 1 and 2, the side of the car door 2 which faces the hoistway walls and the hallway doors is shown. The numeral 4 designates the car header which forms the top of the car doorway when the door 2 is opened. It will be understood that the car door 2 moves to the left and right beneath the fixed header 4 as the door 2 opens and closes. A cam track 6 is fixed to the header 4 above the door 2, and includes a horizontal surface 8 and an adjacent upwardly inclined ramp surface 10. A pair of vanes 12 and 14 are mounted on the car door 2. The vanes 12 and 14 are L-shaped in cross-section and includes arms 16 and 18 respectively which project away from the door 2 into the hoistway toward the hoistway walls and the hallway doors. The lower end of each vane 12 and 14 is pivotally mounted by means of pins 20 and 22 respectively to a spreader bar 24, which in turn is pivotally mounted on a plate 26 by means of a pivot pin 28 positioned between the vane arms 16 and 18. The plate 26 is fixed to the car door 2. The top end of each vane 12 and 14 is pivotally connected to a triangular spreader plate 30 via pivot pins 32 and 34 respectively located approximately at the lower corners of the plate 30. The plate 30 in turn is pivotally mounted on a plate 36 by means of a pivot pin 38 sandwiched between the vane arms 16 and 18. The extent of pivotal movement that the plate 30 may experience is governed by a stop pin 31 which is mounted on the door 2 and which extends into a slot 33 formed in the side of the plate 30. The upper corner of the triangular plate 30 carries a cam roller 40 which is positioned on the horizontal surface 8 of the cam 6 when the door 2 is completely closed, as shown in FIG. 1. Engagement between the roller 40 and the cam surface 8 causes the triangular plate 38 to pivot in the clockwise direction about the pin 38 whereby the vane arms 16 and 18 are moved to a closely adjacent closed or collapsed position. A spring 42 is connected at one end to the door 2 and at its other end to the vane 12, and is operable to bias the vanes 12, 14, and the bar 24 and triangular plate 30 toward an open or expanded position which is shown in FIG. 2.

In FIG. 2, the condition of the vane subassembly is shown after the car door 2 has begun to open. The car door 2 is moved in the direction of the arrow A when opening. The initial fractional movement of the car door 2 in the opening direction moves the roller 40 off of the horizontal surface 8 of the cam track 6. Once the roller 40 leaves the horizontal surface 8, the spring 42 is able to pull the vane 12 upwardly and to the right, as shown in FIGS. 1 and 2. Movement of the vane 12 results in pivoting of the bar 24 about the pin 28, and in pivoting of the plate 30 about its pivot pin 38. The vane arms 16 and 18 are thus spread farther apart when the door 2 opens than they are when it is closed. It will be noted that the stop pin 31 engages opposite ends of the slot 33 to properly position the plate 30, as shown in FIGS. 1 and 2. When the vanes 12 and 14 are in their expanded position as shown in FIG. 2, the pivot pins 32, 34 and 38, and 20, 22 and 24 are all aligned horizontally so that forces acting on the vanes 12 and 14 in the direction opposite to the direction of arrow A will not tend to pivot the assembly back toward its collapsed position shown in FIG. 1. This allows the vane subassembly to act upon the roller subassembly on the hallway doors to open the latter.

Figure 3:
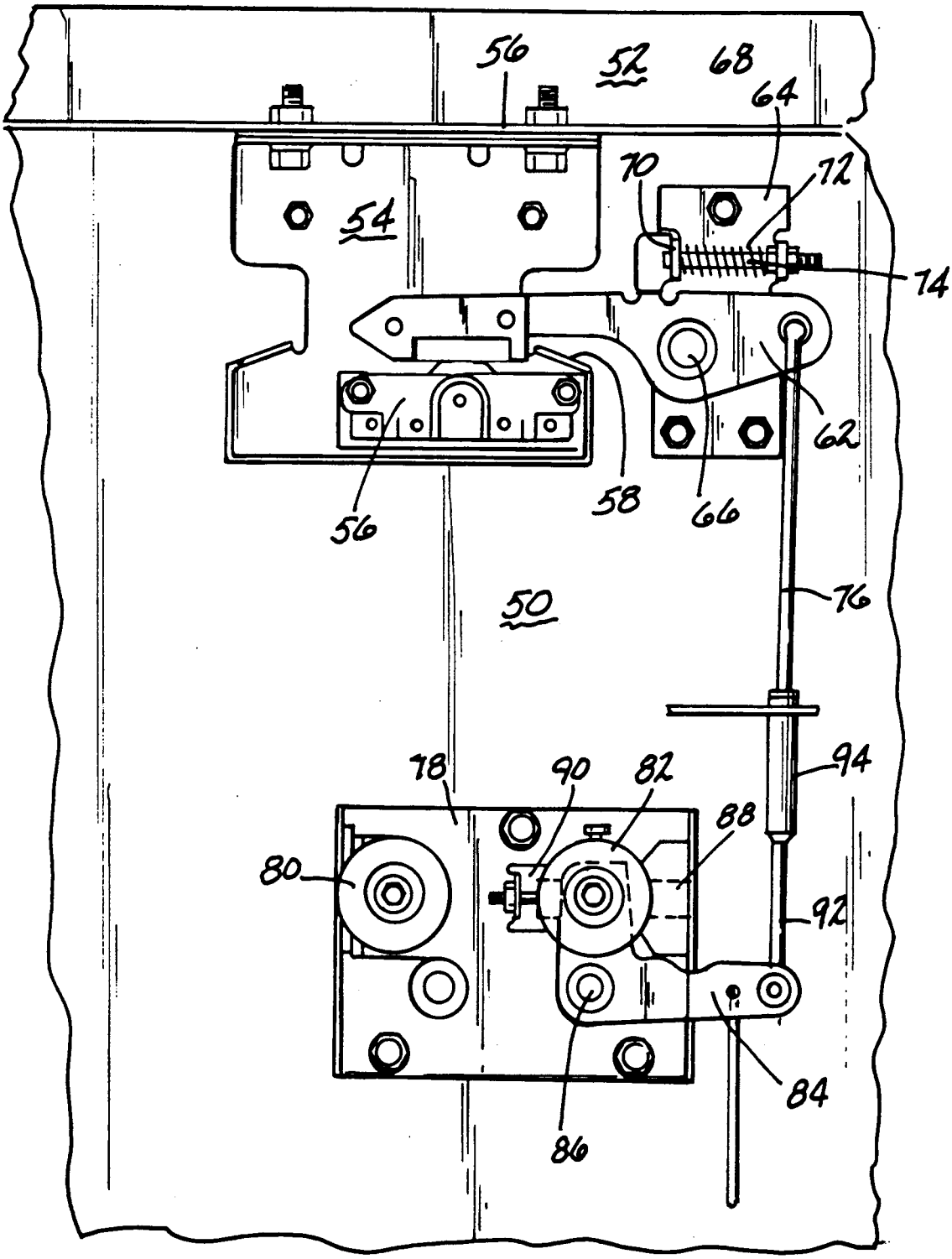
FIG. 3 is a fragmented elevational view of the roller and door lock subassembly of the invention which is mounted on the hallway doors, the latter of which is shown in its closed, locked condition.
Figure 4:
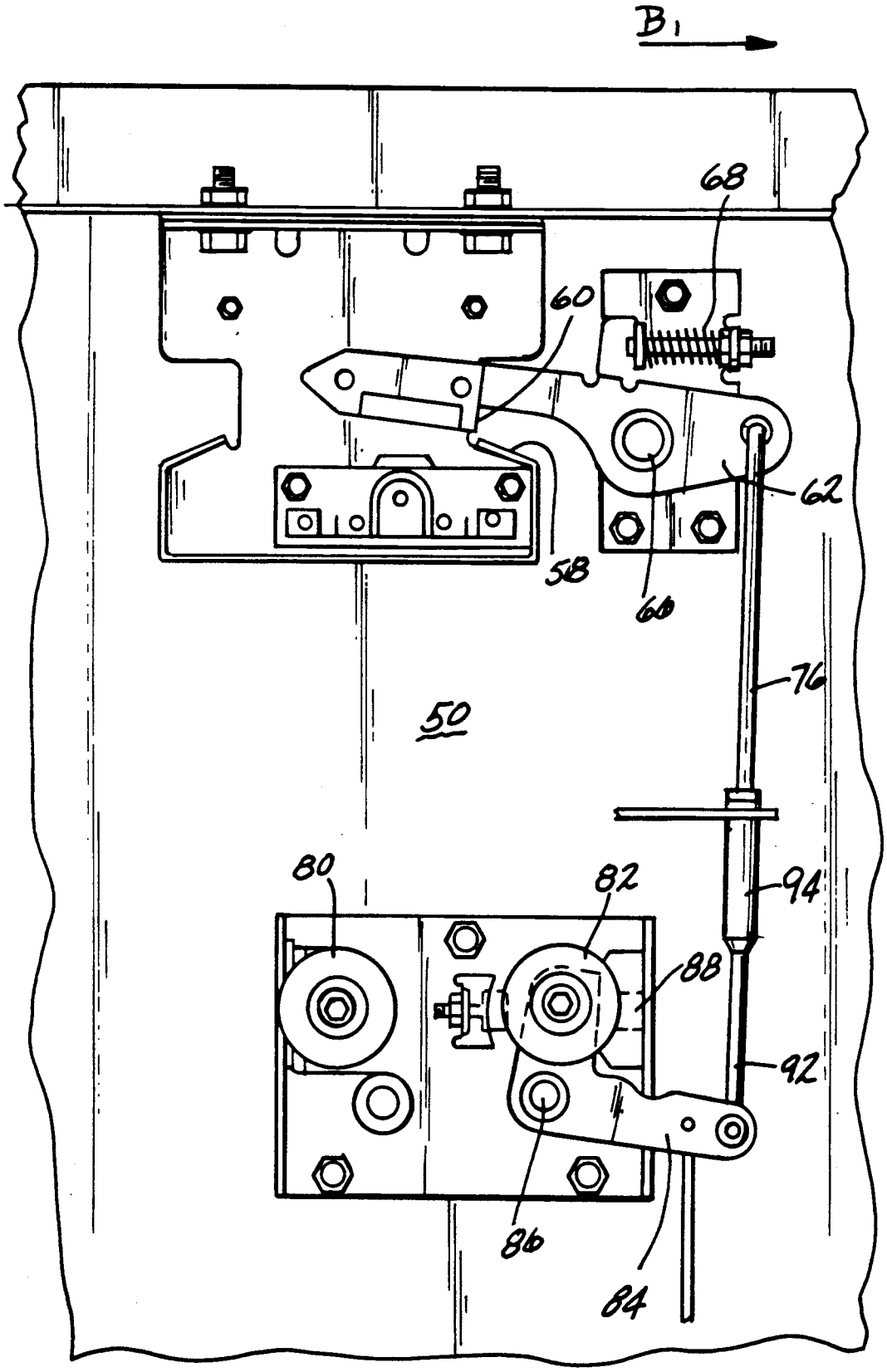
FIG. 4 is a view similar to FIG. 3 but showing the rollers and lock in the unlocked condition when the door is being opened and closed.

Referring now to FIGS. 3 and 4, the hoistway side of the hallway door 50 is shown. The overhead hallway doorway header is denoted generally by the numeral 52. A mounting plate 54 is secured to a flange 56 on the doorway header 52 and extends downwardly therefrom adjacent to the hallway door 50. A hallway door catch 56 is mounted on the plate 54 and has a catch plate 58 which engages a latching shoulder 60 on a door latch 62 mounted on a plate 64 secured to the hallway door 50. It will be understood that when the hallway door 50 is fully closed, the latching shoulder 60 will be slightly spaced apart from the catch plate 58. The latch 62 is pivotally mounted on a pin 66 and is biased in the counterclockwise direction about the pin 66 by a spring 68. One end of the spring 68 engages a shoulder 70 on the latch 62, and the other end of the spring 68 engages a stop 72 mounted on a spring guide 74 secured to the plate 64. A connecting rod 76 is pivotally mounted on the latch 62 and depends downwardly therefrom.

The roller assembly is mounted on a plate 78 secured to the hallway door 50 below the latch assembly. A fixed roller 80 is mounted on the plate 78 and a movable roller 82 is mounted on a lever 84 which is pivotally mounted on the plate 78 on a pivot pin 86. A spring 88 biases the lever 84 in the counterclockwise direction whereby the movable roller 82 is biased toward the fixed roller 80. A stop 90 engages the lever 84 to properly space the rollers 80 and 82 from each other. A connecting rod 92 is mounted on the lever 84 and is connected to the rod 76 by means of an adjustable turnbuckle 94. It will be appreciated that the two springs 68 and 88 operate to maintain a latched condition on the hallway door 50 so long as the latter is disengaged from the car door.

FIG. 4 shows the unlatched condition of the hallway door 50 which results from moving the car door vanes 12 and 14 to their expanded positions shown in FIG. 2. When the vanes 12 and 14 are spread, the vane 14 engages the fixed roller 80 and the vane 12 engages the movable roller 82. The roller 82 is thus driven to the right as viewed in FIG. 4 causing the lever 84 to pivot about the pin 86 in the clockwise direction against the bias of the spring 88. This causes the rods 92, 76 and the turnbuckle 94 to be pulled downwardly. The latch 6 is thus pivoted about the pin 66 in the clockwise direction against the bias of the spring 68 causing the latching shoulder 60 to be lifted away from the catch plate 58. The hallway door 50 is thus unlocked and is free to move in the direction of the arrow $B_1$. From the time the vanes 12 and 14 spread and the hallway door 50 is unlocked, until the time the vanes 12 and 14 collapse and the hallway door 50 is relocked, the two doors 2 and 50 will move together in a precise and constant alignment. Thus opening and closing of the doors occurs as though the doors 2 and 50 are one door.

Figure 5:
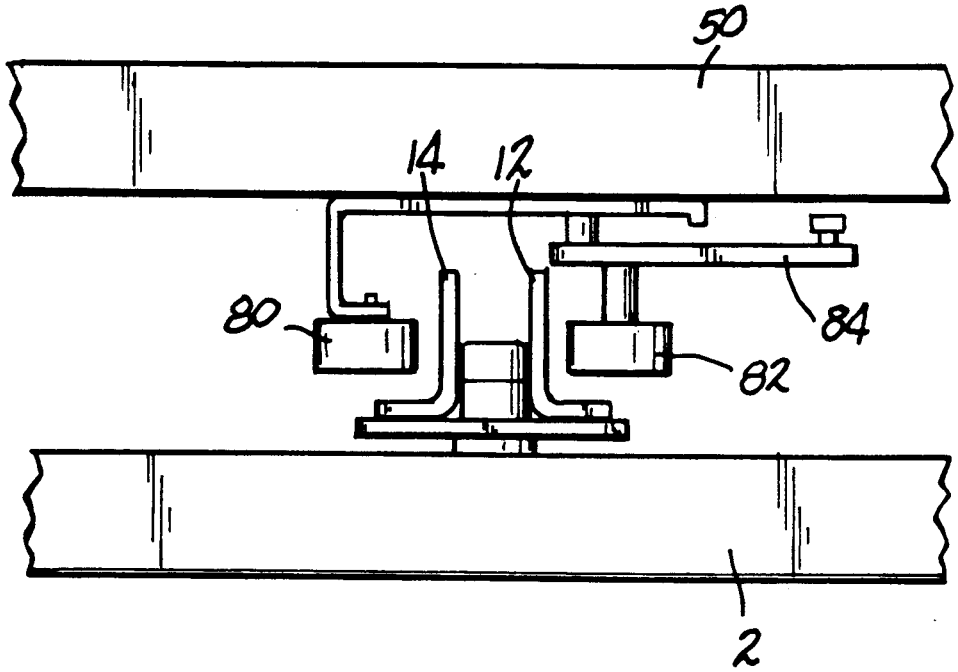
FIG. 5 is a fragmented top plan view of both the car and hallway doors showing the vanes and rollers as they are positioned when both doors are closed and the car is moving up or down in the hoistway.
Figure 6:
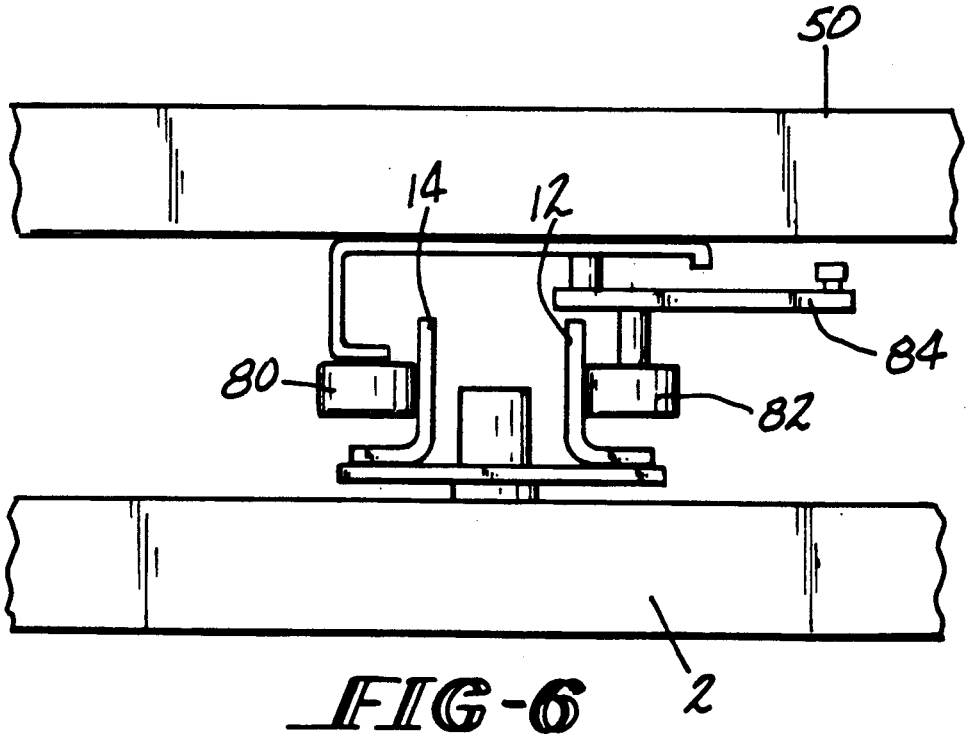
FIG. 6 is a view similar to FIG. 5 but showing the vanes and rollers in their engagement condition when the doors are being opened or closed.

FIGS. 5 and 6 illustrate the relative positions of the vanes 12 and 14 and the rollers 80 and 82 when the subassemblies are disengaged (FIG. 5) and engaged (FIG. 6). It is apparent from FIG. 5 that the vanes 12 and 14 will not touch the rollers 80 and 82 as the car moves up and down in the hoistway. Thus no interference between the car door and hallway doors will occur during travel of the elevator. It is also apparent from FIG. 6 that the vanes 12, 14 and the rollers 80, 82 will retain contact no matter which direction the car door 2 is driven whereby bidirectional movement of the doors 2 and 50 is perfectly synchronous as long as the vanes 12, 14 remain expanded.

It will be readily appreciated that the door coordinating assembly of this invention is of simple construction, and operates reliably to provide synchronous movement of the car and hallway doors during opening and closing of the latter. Interference between the car door and the hallway door is avoided during normal car travel in the hoistway, but interengagement between the car door and hallway door is substantially instantaneous when opening of the car door commences.

Since many changes and variations of the disclosed embodiment of the invention may be made without departing from the inventive concept, it is not intended to limit the invention otherwise than as required by the appended claims.

I claim:

1. An assembly for coordinating movement of an elevator car door and an elevator hoistway hallway door during opening and closing cycles of said doors, said assembly comprising:

(a) a pair of vanes mounted on said elevator car door, said vanes being movable between a closely spaced collapsed position and a farther spaced spread position;

(b) means for biasing said vanes toward said spread position;

(c) a pair of rollers mounted on said hallway door, said rollers being movable from a first position proximate each other to a second position further offset from each other;

(d) spring means operable to urge said rollers toward said first position;

(e) said vanes being positioned on said car door so as to pass freely between said rollers when the latter are in their first position and said vanes are in their collapsed position when the elevator car moves up and down in the hoistway;

(f) stationary cam means on the elevator car for holding said vanes in said collapsed position when said elevator car door is fully closed; and (g) said vanes being interposed between said rollers when the elevator car stops at the hallway door and said vanes being operable by reason of said means for biasing to move to said spread position to engage said rollers when the elevator car door begins to open to move said vanes away from said cam means thereby preventing the latter from holding said vanes, whereby concurrent opening and closing movement of said elevator car door and said hallway door will ensue.

2. The assembly of claim 1 wherein opposite ends of said vanes are connected to spreader means pivotally mounted on said elevator car door whereby pivoting of said spreader means on said elevator car door causes movement of said vanes between said collapsed and spread positions.

3. The assembly of claim 2 wherein said cam means is mounted on said elevator car adjacent said elevator car door and is operable to engage one of said spreader means as said elevator car door closes, whereby both of said spreader means are pivoted on said elevator car door to cause said vanes to move to said collapsed position.

4. The assembly of claim 3 further comprising locking means on said hallway door for locking the latter, said locking means being operably connected to said rollers by connecting means operable to disable said locking means from locking said hallway door when said rollers move to said second position whereby said hallway door can open with said elevator car door.

5. The assembly of claim 3 wherein each of said vanes are pivotally connected to each of said spreader means at pivot axes proximate opposite ends of each of said vanes, said pivot axes at the respective ends of each vane being disposed in a common horizontal plane with the associated spreader means pivot axis when said vanes are in said spread position whereby engagement of said vanes and said rollers during opening and closing of said elevator car door and said hallway door does not impart any pivotal movement to said spreader means.

6. An assembly for coordinating movement of an elevator car door and an elevator hoistway hallway door during opening and closing cycles of said doors, said assembly comprising:

(a) a pair of vanes mounted on said elevator car door, said vanes being movable between a closely spaced collapsed position and a farther spaced spread position by means of spreaders pivotally connected to said vanes and to said car door;

(b) means for biasing said vanes toward said spread position;

(c) a pair of rollers mounted on said hallway door;

(d) said vanes being positioned on said car door so as to pass freely between said rollers when said vanes are in their collapsed position when the elevator car moves up and down in the hoistway;

(e) stationary cam means on the elevator car for contacting one of said spreaders to hold said vanes in said collapsed position when said elevator car door is fully closed; and (f) said vanes being interposed between said rollers when the elevator car stops at the hallway door, and said vanes being operable by reason of said means for biasing to move to said spread position to engage said rollers when the elevator car door is opened, said cam means being disabled from holding said spreader by initial opening movement of said doors, whereby concurrent subsequent opening and closing movement of said elevator can door and said hallway door will ensue.

7. An assembly for coordinating movement of an elevator car door and an elevator hoistway hallway door during opening and closing cycles of said doors, said assembly comprising:

(a) a pair of vanes mounted on said elevator car door, said vanes being movable between a closely spaced collapsed position and a farther spaced spread position;

(b) means for biasing said vanes toward said spread position;

(c) a pair of rollers mounted on said hallway door;

(d) said vanes being positioned on said car door so as to pass freely between said rollers when the latter are in their first position and said vanes are in their collapsed position when the elevator car moves up and down in the hoistway;

(e) stationary cam means on the elevator car for holding said vanes in said collapsed position when said elevator car door is fully closed; and (f) said vanes being interposed between said rollers when the elevator car stops at the hallway door, and said vanes being operable by reason of said means for biasing to move to said spread position to engage said rollers when the elevator car door begins to open to move said vanes away from said cam means thereby preventing the latter from holding said vanes, whereby concurrent opening and closing movement of said elevator car door and said hallway door will ensue.

* * * * *